United States Patent [19]

Solomon

[11] Patent Number: 4,702,477

[45] Date of Patent: Oct. 27, 1987

[54] GOLF PUTTER

[76] Inventor: James R. Solomon, R.R. 2, Box 220, Middletown, Ind. 47356

[21] Appl. No.: 759,420

[22] Filed: Jul. 26, 1985

[51] Int. Cl.[4] ..... A63B 53/02; A63B 53/06

[52] U.S. Cl. ..... 273/80 C; 273/80.2; 273/169; 273/80 A; 273/171

[58] Field of Search ..... 273/80 C, 80 A, 164, 273/167 F, 169, 167 G, 80.2; D21/217, 218, 219

[56] References Cited

U.S. PATENT DOCUMENTS

| | | | |
|---|---|---|---|
| D. 242,730 | 12/1976 | Pappas | D21/217 |
| 792,631 | 6/1905 | Taylor | 273/164 |
| 2,155,830 | 4/1939 | Howard | 273/167 G |
| 3,064,975 | 11/1962 | Smith | 273/80 C |
| 3,815,910 | 6/1974 | Raines | 273/80 C |
| 3,876,211 | 4/1975 | Caligiuri | 273/164 X |
| 3,967,826 | 7/1976 | Judice | 273/164 X |

*Primary Examiner*—George J. Marlo

*Attorney, Agent, or Firm*—Woodard, Emhardt, Naughton Moriarty & McNett

[57] ABSTRACT

A golf putter for putting a ball along a path of desired golf ball travel includes a head having a planar striking surface. A horizontal extension from the head positions the shaft in a vertical plane ½ inch to 2 inches rearward of the head. The extension provides the connecting link between the shaft and the rear surface of the head and locates the center of gravity of the head between the shaft and the ball to be stroked when the head is in a striking position relative to the ball.

4 Claims, 3 Drawing Figures

GOLF PUTTER

BACKGROUND OF THE INVENTION

1. Field of the Invention

This invention is in the field of sporting goods equipment, and more particularly golf putters. The game of golf is very old and a wide variety of clubs have been designed and used, many of which have been patented. I am a gold pro and thus, am exceedingly familiar with the wide variety of putters on the market today as well as most of the putters used in the past. I believe the putter disclosed is new as compared to past and present putters.

Putting is a skill that takes many hours of practice, and often many years of golfing, to master. A golfer, in order to be a good putter, must have many different skills. The golfer must be able to "read the green", that is be able to determine the "break" in the green and the "speed" of the green, in order to determine the direction in which he will putt the ball and the strength of the stroke which he will apply to the ball. Even if the golfer is able to correctly read the green, the golfer will often miss a putt because the stroke he applies to the ball somehow varies from his "reading" of the green. The putter disclosed herein will help to maximize the probabilities that the golfer's stroke will correspond to the way in which the golfer read the green.

The putter is designed so that the shaft of the putter is completely behind the center of gravity of the putter's head. Previous putter designs had the shaft entering the putter head either at or in front of the center of gravity of the putter head. These previous designs often led to the golfer either driving the ball into the green during his putt, or "driving the putter head" into the green before striking the ball. All of these putter designs required a golfer, in order to "keep his eye on the ball", to direct his eyes to a position directly between his feet. This reduced the golfer's ability to see both the ball and the intended line of travel of the ball at the same time. Additionally, prior designs required the golfer to impart a starting force on the club in order to start his backswing. Driving the ball into the green, driving the putter into the green, not being able to visualize the line of travel, and a "hitch in the backswing" often lead to missed putts. The design of the putter disclosed herein has the shaft located well behind the striking surface and the center of gravity of the head and helps to minimize these problems.

My putter allows the golfer to keep the putter head lower without contacting the head with the green before contacting the ball. As a result, when the golfer follows through after striking the ball, the putter imparts an increased top spin on the ball which gives the ball a truer roll than the prior putters. Prior putters tried to alleviate the problem of driving the ball into the green by putting an angle on the face of the putter. The design disclosed in this application also incorporates this angle feature to minimize the probability of driving the ball into the green. Also the design of the putter helps to aid the golfer in starting his backswing. The center of gravity of the club, when the shaft is held vertically to address the ball is in front of the shaft. The club head acts like a displaced weight on a pendulum and, therefore, helps the golfer to start his backswing without the need of the golfer imparting force on the club to start the swing. This reduces the possibility of the golfer having a "hitch" in his backswing.

A further benefit of the design of my club is that when the shaft is held in a vertical plane in order to address the ball, the ball is not directly between the player's feet but rather closer to the front foot than the back foot. Thus, a player must turn his head slightly toward the direction fo the hole to see the ball. The slight turn greatly increases the amount of green within the player's peripheral vision, and therefore allows the player to both on the ball and keep his eye on the line of intended travel at the same time. Thus, it can be sen that the club helps to alleviate many of the problems inherent in previous putters.

SUMMARY OF THE INVENTION

One embodiment of the present invention is a golf putter comprising an elongated shaft having a longitudinal axis and further having a gripping means attached to its proximate end, the distal end of the shaft is attached by an attaching means to a head that has a planar striking surface, a rear surface, a sole surface extending between the planar striking surface and the rear surface, and a top surface extending between the planar striking surface and the rear surface. The shaft is attached to the head so that the center of gravity of the head is between the longitudinal axis of the shaft and the planar striking surface, the planar striking surface is arranged at a critical angle to the first longitudinal axis to impart an upward force component to a golf ball upon striking it.

It is an object of the present invention to provide a golf putter capable of providing an upward force component to a golf ball upon striking to prevent the golf ball from being driven into the green and providing the golf ball with top spin.

A further object of the present invention is to provide a golf putter that has its head and shaft arranged so that the weight of the head will aid the golfer in beginning his backswing.

Yet another object of the present invention is to provide a golf putter having its shaft arranged so that when a golfer addresses the golf ball the golfer's peripheral vision of the green will be increased.

Related objects and advantages of the present invention will be apparent from the following description.

DESCRIPTION OF THE PREFERRED EMBODIMENT

Figure 1:
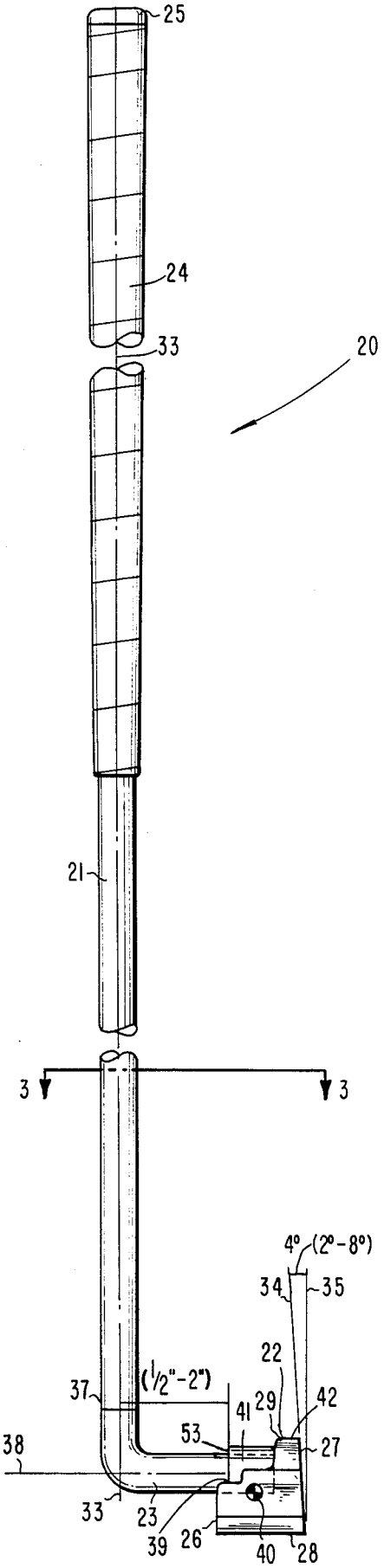
FIG. 1 is a side elevation view of a golf putter according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated golf putter 20 which includes an elongated shaft 21, a head 22 and a shank 23 connecting shaft 21 and head 22 together. Shaft 21 includes a gripping means 24 attached to the proximate end 25 of the shaft. Shaft 21, shank 23 and club head 22 may all be fabricated from a single integral piece of metal or similar material and thus it is not required that the various component parts which make up golf putter 20 be fabricated as individual parts and then assembled.

However, conventional golf club construction dictates that normally the head 22 and shank 23 are drawn together at the fabricated stage such as by a casting or forging operation and the distal end 37 of the particular shaft 21 is then secured to the shank 23. The desirability in attaching the shaft 21 as a separate component part is that this member is typically constructed of a different material than the head 22 and the shank 23 and is fabricated in a different manner. There is also a secondary advantage to this separate construction concept, and that is that the shaft 21 may be varied as to its stiffness and length while the head 22 and shank 23 remain the same. As it will be come apparent hereinafter, it is envisioned as part of the concept associated with the present golf putter invention that the shank 23 may be fabricated as a replaceable item such that it would be separately joined to the head 22 and to the shaft 21 rather than be casted or forged as part of the head. This replaceable or interchangeable concept enables the shank 23 characteristics to be revised without the necessity to change the shaft 21 or the head 22 configuration.

Figure 3:
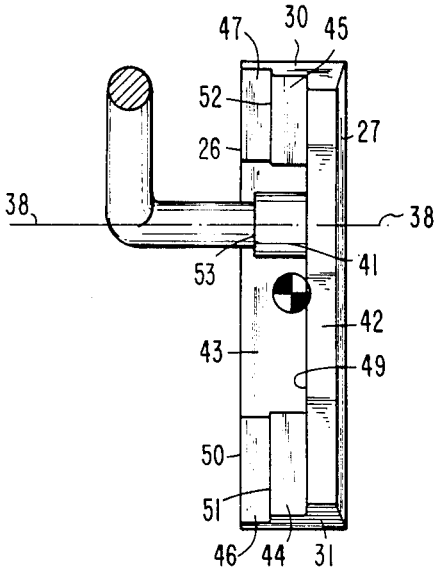
FIG. 3 is a cross sectional view taken along the line 3—3 of FIG. 1 and viewed in the direction of the arrows.
Figure 2:
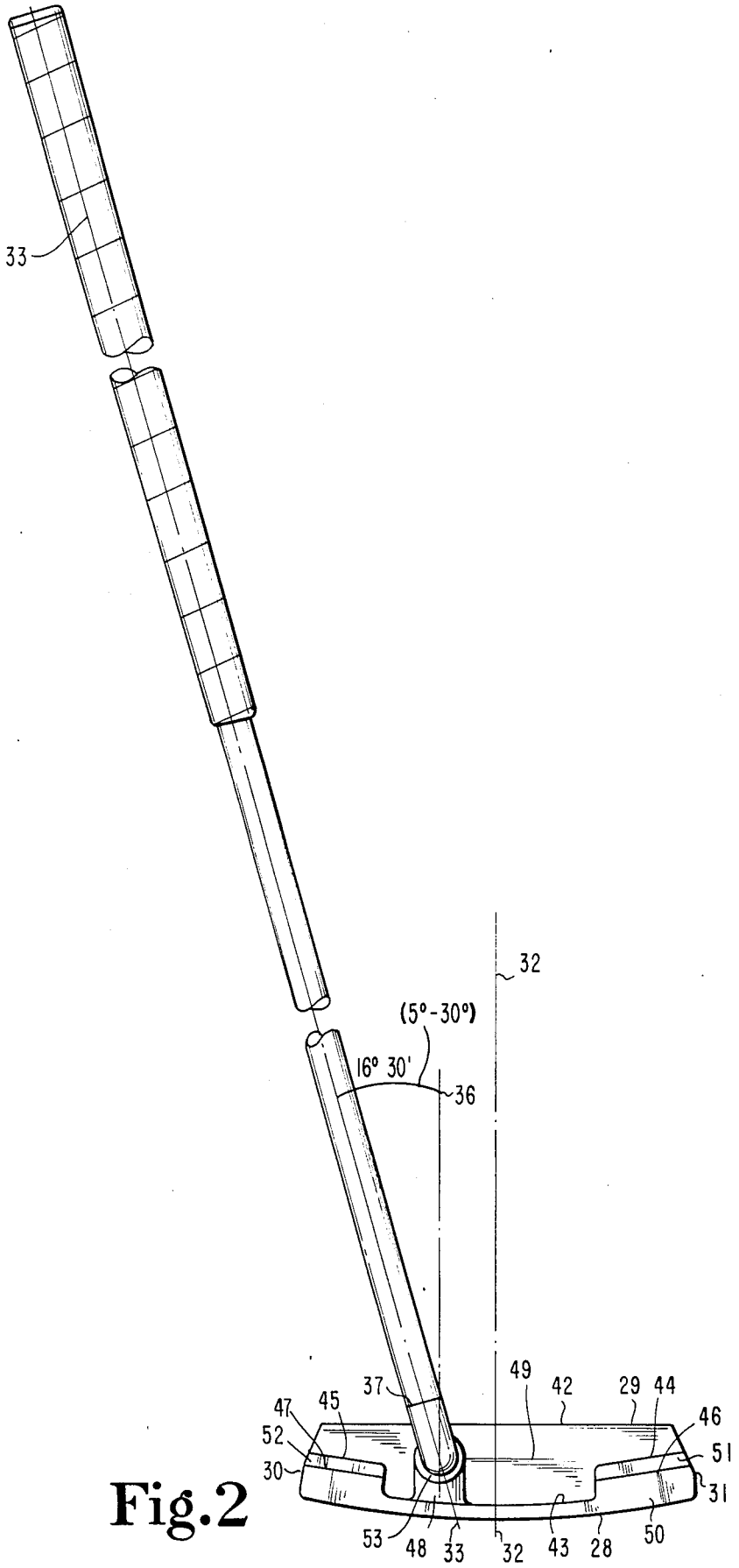
FIG. 2 is a rear elevation view of the putter.

Referring to FIGS. 1, 2 and 3, the head 22 and shank 23 will be described and discussed in greater detail. Head 22 includes a rear surface 26, a planar ball striking surface 27, a sole portion 28 having a curvature and extending between rear surface 26 and planar striking surface 27 and a substantially flat top surface 29 also extending between rear surface 26 and planar striking surface 27. It is to be understood that golf putter 20 is arranged for a right handed golfer in that shaft 21 extends at an incline from its point of connection with shank 23 toward the area where a golfer would stand. Therefore, heel 30 is that end of head 22 which is closer to the golfer and toe 31 of head 22 is that end which is farthest from the golfer. The curvature to sole portion 28 can be best be illustrated by referring to FIG. 2 wherein the sole portion 28 upwardly and outwardly diverges from center line 32 toward heel 30 and toe 31.

Shaft 21 is generally cylindrical throughout, although slightly tapering, and has a first longitudinal axis which is coincident and represented by line 33. The planar striking surface 27 is disposed in a ball striking geometric plane represented by line 34 in FIG. 1. Planar striking surface 27 is inclined in an upward and rearward manner to provide approximately four degrees of positive loft. This loft is illustrated by the angle between line 34 and a vertical plane contacting said planar striking surface 27 at its forwradmost point and represented by line 35. The relationship between the first longitudinal axis line 33 and the planar striking geometric plane 34 is best illustrated in FIG. 1. As can be seen from FIG. 1 first longitudinal axis 33 lies in a vertical plane totally parallel to line 35 which represents a plane contacting the forwardmost point upon the planar striking surface 27. While the preferred embodiment incorporates a four degree positive loft, it is envisioned the positive loft of the planar striking surface may range from two degrees to eight degrees.

The amount of the incline of the shaft 21 in the direction of the golfer is best illustrated in FIG. 2. The longitudinal axis 33 is inclined sixteen degrees, thirty seconds from a vertical line 36 intersecting longitudinal axis 38 of shank 23. This angle may vary from five degrees to thirty degrees and still be consistent with the teachings of this disclosure.

Reference to line 33 being rearward of planar striking surface 27 is based upon the concept that the forward direction is the direction of desired gold ball travel and it is planar striking surface 27 which contacts the golf ball in order to direct it along this desired path of travel. A further relationship between first longitudinal axis line 33 and head 22 is illustrated in FIG. 1 in which it is illustrated that line 33 extends past head 22 entirely on one side of the head 22.

Shaft 21 and head 22 are joined by a shank 23 having a second longitudinal axis represented by line 38. When the head 22 is in a striking position relative to the ball, the second longitudinal axis 38 lies entirely within a horizontal plane. As is illustrated in FIG. 1, first longitudinal axis 33 and second longitudinal axis 38 intersect to form right angles. Shank 23 is of sufficient length so that the distance between line 33 representing the longitudinal axis and line 35 representing a vertical plane contacting the forward motion point of the planar striking surface is two inches. It is envisioned that shank 23 may be of a maximum length of two inches or have a length from ½ to 2 inches, causing shaft 21 to be behind the center of gravity 40 of head 22.

Shank 23 enters head 22 on its rear surface 26 as is best illustrated in FIG. 2. The shank 23 enters head 22 so that a vertical line 36 intersecting the longitudinal axis 38 of shank 23 is nineteen thirty-seconds of an inch from center line 32 of head 22. It is envisioned that shaft 21 and shank 23 may be arranged differently with respect to the center line 32 of the head. As is clearly illustrated, shank 23 enters head 22 well above sole 28. Various means of attachment of shank 23 to head 22 are envisioned. Illustrated in the drawings and in the preferred embodiment, the method of attaching the shank 23 to the head 22 is accomplished by a cavity 39 sized to allow the outside diameter of shank 23 to be inserted snuggly therein. Various means of securing such shank within such cavity are envisioned, such as gluing, welding, and forging.

Up to this point in the description of this invention, reference has been made generally to the rear surface 26, and top surface 29, and although under conventional golf putter designs, the rear surface and top surface are normally continuous in nature being either flat or slightly curved, rear surface 26 and top surface 29, disclosed herein are actually very complex in nature.

Top surface 29 actually consists of 6 surface areas, excluding the surface formed by cylindrical housing 41, a generally flat uppermost surface 42, a lowermost upward surface 43 having the same focus of curvature as sole surface 28, an upper toe surface 44 and an upper heel surface 45 having the same radius of curvature as each other from the same focus of curvature as sole surface 28, and lower toe surface 46 and lower heel surface 47 having the same radius of curvature as each other from the same focus of curvature as sole surface 28. Upper toe surface 44 and lower toe surface 46 extend the same distance from the toe 31 toward the center line 32 of the head, and upper heel surface 45 and lower heel surface 47 also extend the same distance toward center line 32 from heel 30. Rear surface 26 consists of 4 surface areas, excluding the rearward surfaces of cylindrical housing 41 and cylindrical housing support 48. The forward rear surface 49 lies in a vertical plane, the rearward rear surface 50 also is vertical and the middle toe rear surface 51 and middle heel surface 52 lie in a vertical plane between forward rear surface 49 and rearward rear surface 50. The combinations of the top surfaces and rearward surfaces create ahead weighted at the toe and the heel as is illustrated.

One particular point of complexity is the point where the shank 23 attaches to the head 22, which consists of a cylindrical housing 41 having a longitudinal axis of symmetry coincident with second longitudinal axis 38. Cylindrical housing 41 contains a cavity 39 internally sized to fit the outside diameter of shank 23. Cylindrical housing 41 is fixedly attached to forward rear surface 49 and has a rear surface 53 which lies in a vertical plane between the rearward rear surface 50 and the middle toe rear surface 51 and the middle heel rear surface 52. Cylindrical housing 41 is fixedly attached to the lower most upper surface 43 by a cylindrical housing support 48.

The above disclosed invention helps to reduce the probability of error in putting a golf ball by increasing the golfer's peripheral vision in the direction of the desired path of golf ball travel, by imparting top spin to the golf ball when stroked and by aiding the golfer in starting his or her backswing. When the head 22 of the putter 20 is positioned behind the golf ball and the shaft 21 is held in a vertical plane, the golf ball, rather than being positioned directly between the golfer's feet (as is the case with previous putters), is located two inches closer to the golfer's front foot than is normally the case. This positioning of the golf ball requires the golfer to turn his or her head slightly in the direction of desired travel. This slight turn of the head greatly increases the golfer's peripheral vision in that direction. Additionally, the arrangement disclosed lifts the head 22 of the putter 20 more quickly through the arc of the golfer's followthrough than is typically the case with prior designs, thereby imparting increased top spin on the golf ball and imparting an upward force component to the ball. Finally the location of the center of gravity 40 of the head 22 in front of the shaft 21 causes the putter 20 to act as a displaced pendulum. The weight of the head 22 being displaced from the vertical plane in which the shaft 21 is held begins the backswing of the putter 20 without the golfer being required to impart a starting force. Since the golfer is not required to impart a starting force to overcome the inertia of the club at rest, it is less likely that the golfer will have a hitch in his or her backswing.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A golf putter for putting a golf ball along a path of desired golf ball travel, said golf putter comprising;

a stright elongated shaft having a distal end and a proximate end, said shaft having a first longitudinal axis which lies in a vertical plane when said head lies in a striking position relative to said ball, said first longitudinal axis forming an angle between 5° and 30° with respect to an imaginary vertical line extended through said distal end;

a gripping means attached to said shaft adjacent said proximate end of said shaft and along the longitudinal axis thereof;

a head having a heel, a toe and a plurality of surfaces, including a planar striking surface, a rear surface, a sole surface extending between said planar striking surface and said rear surface, said sole surface additionally having a uniform arcuate curvature extending between said heel and said toe, and a top surface extending between said planar striking surface and said rear surface, said head having a center of gravity;

an attachment means for attaching said head to said distal end of said shaft so that said planar striking surface is between the golf ball to be stroked and said shaft, and so that, further, said center of gravity is between said first longitudinal axis and said planar striking surface, said attachment means including a straight shank having a second longitudinal axis said shank having a length such that the shaft is positioned ½ inch to 2 inches rearward of the head, said second longitudinal axis intersecting said first longitudinal axis at a right angle, and a cylindrical support section coaxial with said shank, said cylindrical support section joining said shank to said rear surface of said head at a point above the uppermost point of said sole surface whereby said shank is entirely above said sole surface, said second longitudinal axis being perpendicular to a horizontal line on said planar striking surface.

2. The golf putter of claim 1 wherein said planar striking surface is forward of said first longitudinal axis and arranged at a critical angle to said first longitudinal axis to impart an upward force component to the golf ball upon striking.

3. The putter of claim 1 wherein an imaginary plane coplanar with said planar striking surface is 2° to 8° from vertical when said head lies in a striking position relative to the ball, said planar striking surface being arranged to impart an upward force component to said ball upon striking.

4. The putter of claim 1 wherein said shank is designed and arranged to position the entire head between said shaft and the golf ball to be stroked when said head lies in a striking position relative to the ball.

* * * * *

UNITED STATES PATENT AND TRADEMARK OFFICE

CERTIFICATE OF CORRECTION

PATENT NO. :4,702,477

DATED :October 27, 1987

INVENTOR(S) :James R. Solomon

It is certified that error appears in the above-indentified patent and that said Letters Patent is hereby corrected as shown below:

In the Drawings:

In FIG. 1, the dimension of 1/2"-2" should extend from line 33 to line 35.

Signed and Sealed this

Twenty-first Day of June, 1994

Bruce Lehman

*Attest:*

BRUCE LEHMAN

*Attesting Officer*

*Commissioner of Patents and Trademarks*